US005771879A

United States Patent [19]

Saltzman

[11] Patent Number: 5,771,879

[45] Date of Patent: Jun. 30, 1998

[54] HEATED MAKEUP AIR SYSTEM FOR A COMMERCIAL KITCHEN

[75] Inventor: Todd J. Saltzman, Raleigh, N.C.

[73] Assignee: Captive-Aire Systems, Inc., Youngsville, N.C.

[21] Appl. No.: 611,454

[22] Filed: Mar. 22, 1996

[51] Int. Cl.[6] ..... F24C 15/08

[52] U.S. Cl. ..... 126/299 R; 126/299 D; 126/299 F; 236/49.1; 431/29

[58] Field of Search ..... 126/299 R, 299 D, 126/299 F; 236/49.1; 431/29

[56] References Cited

U.S. PATENT DOCUMENTS

| | | | |
|---|---|---|---|
| 4,085,735 | 4/1978 | Kaufman et al. | 126/299 E |
| 4,773,471 | 9/1988 | Grant et al. | 165/3 |
| 4,887,587 | 12/1989 | Deutsch | 129/299 D |
| 5,524,556 | 6/1996 | Rowlette et al. | 236/49.1 |

*Primary Examiner*—Larry Jones
*Attorney, Agent, or Firm*—Rhodes, Coates & Bennett, LLP

[57] ABSTRACT

A heated air makeup unit comprises a duct structure having a surrounding wall, a fan for moving air through the duct structure, and a gas burner mounted in the duct structure for heating air being moved past the burner. A pair of laterally spaced converging air-directing plates are disposed outwardly of the burner but inwardly of the surrounding walls of the duct structure for directing air into and through the burner. The laterally spaced converging plates define three air passageways through the duct structure, two outer air passageways between the respective plates and the surrounding walls of the duct structure and a third intermediate air passageway between the two plates with the intermediate air passageway being aligned with the burner. A preprogrammed heater control unit continuously monitors temperature, airflow and the flame about the burner and at the same time controls the temperature of the heated air being expelled from the heated air makeup unit.

26 Claims, 7 Drawing Sheets

HEATED MAKEUP AIR SYSTEM FOR A COMMERCIAL KITCHEN

FIELD OF THE INVENTION

The present invention generally relates to a direct gas-fired makeup air system for heating outside air and directing the heated outside air into a commercial kitchen to replace air exhausted therefrom.

BACKGROUND OF THE INVENTION

Commercial kitchens typically include one or more exhaust fans that remove smoke, steam, and other air-polluting substances from areas where stoves, grills, ovens, dishwashers, etc. are located. To replace the exhausted air, commercial kitchens typically utilize makeup air intake systems that force in outside air. These makeup air systems basically consist of a duct structure open to both the outside atmosphere and the kitchen, a fan for blowing air through the duct structure into the kitchen, and a control system for activating and monitoring the makeup air system as needed. However, in cold climates, outside air that replaces exhausted air may lower the temperature in the kitchen to below a comfortable level. Therefore, makeup air systems often include heating units such as gas burners to heat the makeup air before it is blown into the kitchen.

As those familiar with gas burners are aware, optimum burner efficiency is only achieved using a proper mixture of air and gas. Therefore, in addition to gas pressure and volume, the velocity and volume of the combustion air helps determine how hot and efficient a gas burner operates. Too little air for a given amount of gas results in an overly rich air/gas mixture, which causes incomplete combustion and a cool flame. Too much air for a given amount of gas results in an overly lean air/gas mixture, which can cause overheating of the burner if the overabundance of air does not blow the flame out entirely. Therefore, the volume and velocity of the combustion air flowing into and past the gas burner is crucial for producing an efficient, clean-burning flame.

In the past, gas-fired makeup air systems have utilized various structures in conjunction with the gas burners to regulate the volume and velocity of combustion air. Such structures have included adjustable air-regulation panels mounted in the air duct, which are disposed transversely to the path of airflow to form an air intake window upstream from the burner. To regulate the amount of air that passes through the air intake window to the burner, the window may be opened and closed by adjusting the plates. However, it has been found that it is very difficult to properly adjust the panels that form the intake window so as to provide an optimum flow rate and air velocity past the gas burner. This adjustment is also made difficult by the fact that the capacity of the fans incorporated into some of the direct-fired air makeup unit will vary and in order to achieve an optimum flow rate and air velocity past a gas burner, it follows that the panels of the intake window must be adjusted to match the airflow capacity of the fans. Another problem with the adjustable panels is that the final adjustment is often left to individuals installing the heated air makeup unit and these individuals are not always properly trained as to how the panels should be adjusted for a particular setup and for a particular fan capacity. Finally, it is not unusual for the panels through vibration or the like over a period of time to move and assume positions out of adjustment. When this happens, the airflow and air velocity that passes the gas burner become less than optimum and accordingly, the combustion characteristics of the gas burner are adversely affected.

OBJECTS AND SUMMARY OF THE INVENTION

The primary-object of the present invention is to provide a direct gas-fired makeup air system that includes fixed, non-adjustable air-regulation plates that direct optimum amounts of air to the gas burner resulting in an efficient clean burning gas burner.

Another object of the present invention is to provide a gas-fired makeup air system that is compatible with a variety of fans with a wide range of airflow capacities.

The present invention achieves these and other objects by providing a commercial kitchen makeup air system for heating outside air and directing the same into a commercial kitchen to replace exhausted air. As with conventional makeup air systems, the makeup air system of the invention includes an enclosed duct structure open at one end to outside air and at the other end to the commercial kitchen; a fan for blowing air through the duct structure from the outside into the kitchen; and a gas burner mounted in the duct structure upstream from the fan for heating the makeup air before it is blown into the kitchen.

The gas burner used in the makeup air system of the invention is preferably the type that includes a head portion and a pair of diverging mixing plates projecting downstream from the head portion. As seen from a top view, this type of gas burner has a generally "V" shape with the head portion at the bottom of the "V" and the mixing plates forming the sides of the "V". Both mixing plates are perforated with a plurality of air holes, which deliver combustion air to the interior of the burner. There, the air and gas are mixed and combusted. The gas burner is preferably mounted centrally in the duct structure so that the burner is surrounded by a substantially open space, except for necessary mounting brackets and gas lines.

Unlike conventional heated makeup air systems for commercial kitchens, which employ adjustable air-regulation panels upstream from the burner, the makeup air system of the present invention includes a pair of fixed, non-adjustable air-directing plates mounted on opposite sides of the burner. The air-directing plates are laterally spaced, one on each side of the burner, so that they extend alongside and adjacent the mixing plates. The air-directing plates of the invention are preferably not parallel to the mixing plates of the burner but instead converge in the downstream direction so that each air-directing plate and adjacent mixing plate become progressively closer to each other in the downstream direction. Thus, as seen from a top view, the gas burner and converging air-directing plates together form a generally "M" shape, except that the mixing plates and air-directing plates preferably do not contact each other at the top of the "M". Also, in the preferred embodiment, the fixed air-directing plates extend upstream past the head portion of the burner for some distance.

The air-directing plates preferably do not contact the sidewalls of the duct structure but are spaced inwardly therefrom so as to define three air passages through the duct structure in the vicinity of the burner. These include two outer air passages between respective air-directing plates and the adjacent sidewalls of the duct structure, and a central air passage defined between the plates and aligned with the burner. Because the air-directing plates converge in a downstream direction, they direct air entering the central air passage into and through the mixing plates of the burner for combustion. Air entering the two outer air passage bypasses the burner but is combined upstream from the burner with heated air that has passed through the central passageway and the burner.

The design of the fixed, converging air-directing plates in the heated makeup air system of the invention gives rise to an air velocity profile across the burner that maintains an efficient combustion process for a wide range of airflow rates through the duct structure. Therefore, even if the airflow rate varies, such as from adjusting the fan speed, or from changing weather conditions, the makeup air system of the invention requires no adjustments to achieve optimum combustion. In addition, the makeup air system of the invention is compatible with practically all sizes of commonly used fans and motors, which deliver a wide range of airflow capacities. This versatility greatly simplifies operation in a commercial kitchen and significantly improves the air quality in the kitchen.

Other objects and advantages of the present invention will become apparent and obvious from a study of the following description and the accompanying drawings, which are merely illustrative of the invention.

DETAILED DESCRIPTION OF THE INVENTION

Figure 1:
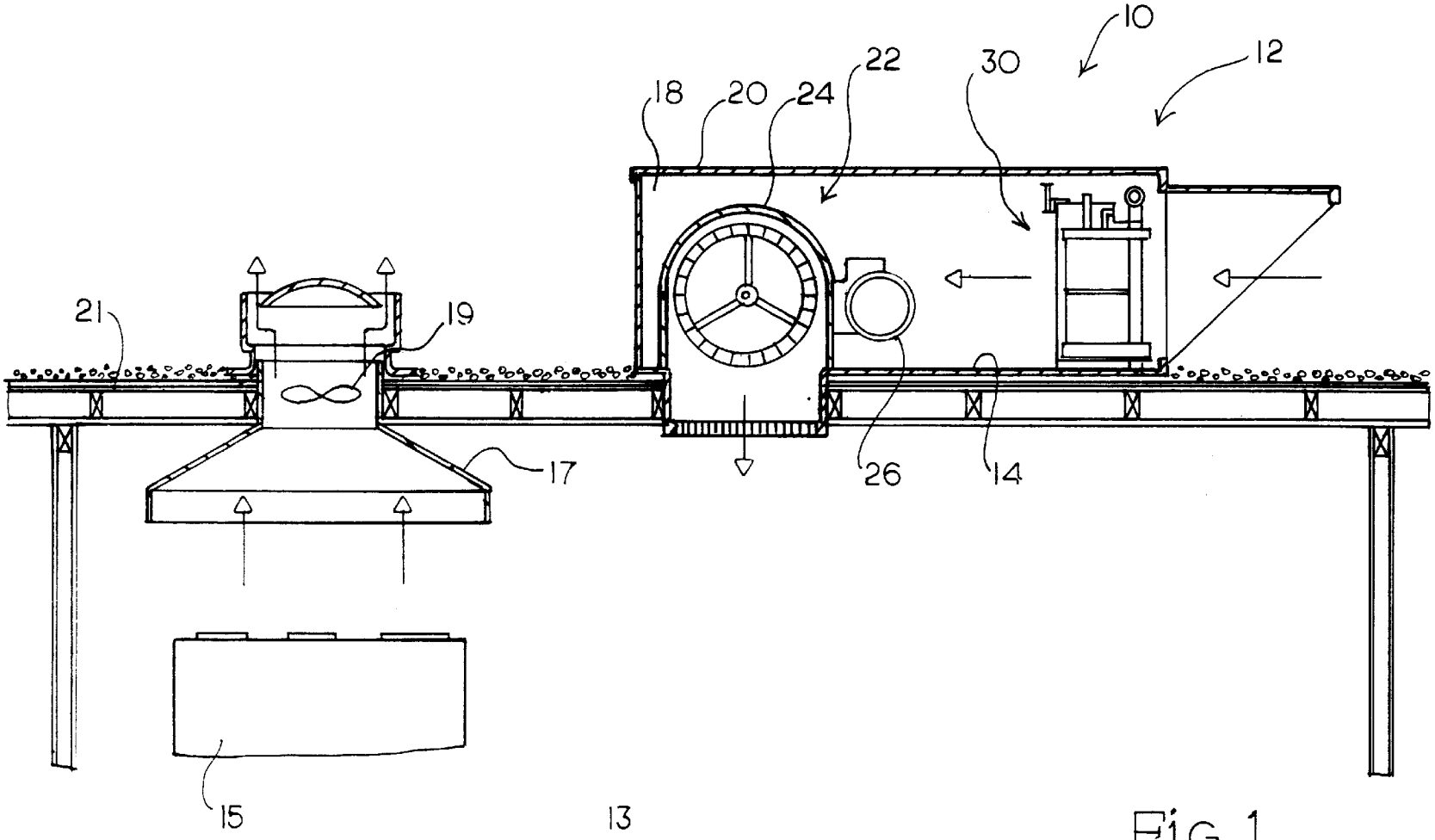
FIG. 1 is a schematic illustration of a commercial kitchen showing the direct gas-fired makeup air unit of the present invention mounted on the roof thereof.

With further reference to the drawings, particular FIG. 1, the heated air makeup unit of the present invention is shown therein and indicated generally by the numeral 10. As shown by the drawings, the heated air makeup unit of the present invention is particularly designed to be used in a commercial kitchen environment. As such, the heated air makeup unit 10 is mounted on the roof 21 of a restaurant where the same overlies a kitchen area indicated generally by the numeral 13. Within the kitchen area 13 of the restaurant, there is typically provided a stove or cooking unit 15. Disposed above the stove 15 is an exhaust hood 17 that is connected to an outlet formed in the roof 21. Formed in the outlet is an exhaust fan 19. Thus, during normal cooking operations within the kitchen area 13, the exhaust fan 19 is operative to pull air from the kitchen area 13 past the stove 15 and other components within the kitchen and to exhaust that same air out through the roof 21 of the restaurant.

Because air is continuously exhausted from the kitchen area 13, it is important that fresh air be replenished into the kitchen area. During winter operation in colder climates, it is of course desirable to heat the ambient air being pulled from outside the kitchen area 13. Accordingly, the heated air makeup unit 10 of the present invention is designed to induce a system of air from the outside of the restaurant into the kitchen area 13 and at the same time in colder conditions to actually heat the air being forced into the kitchen area 13.

Figure 2:
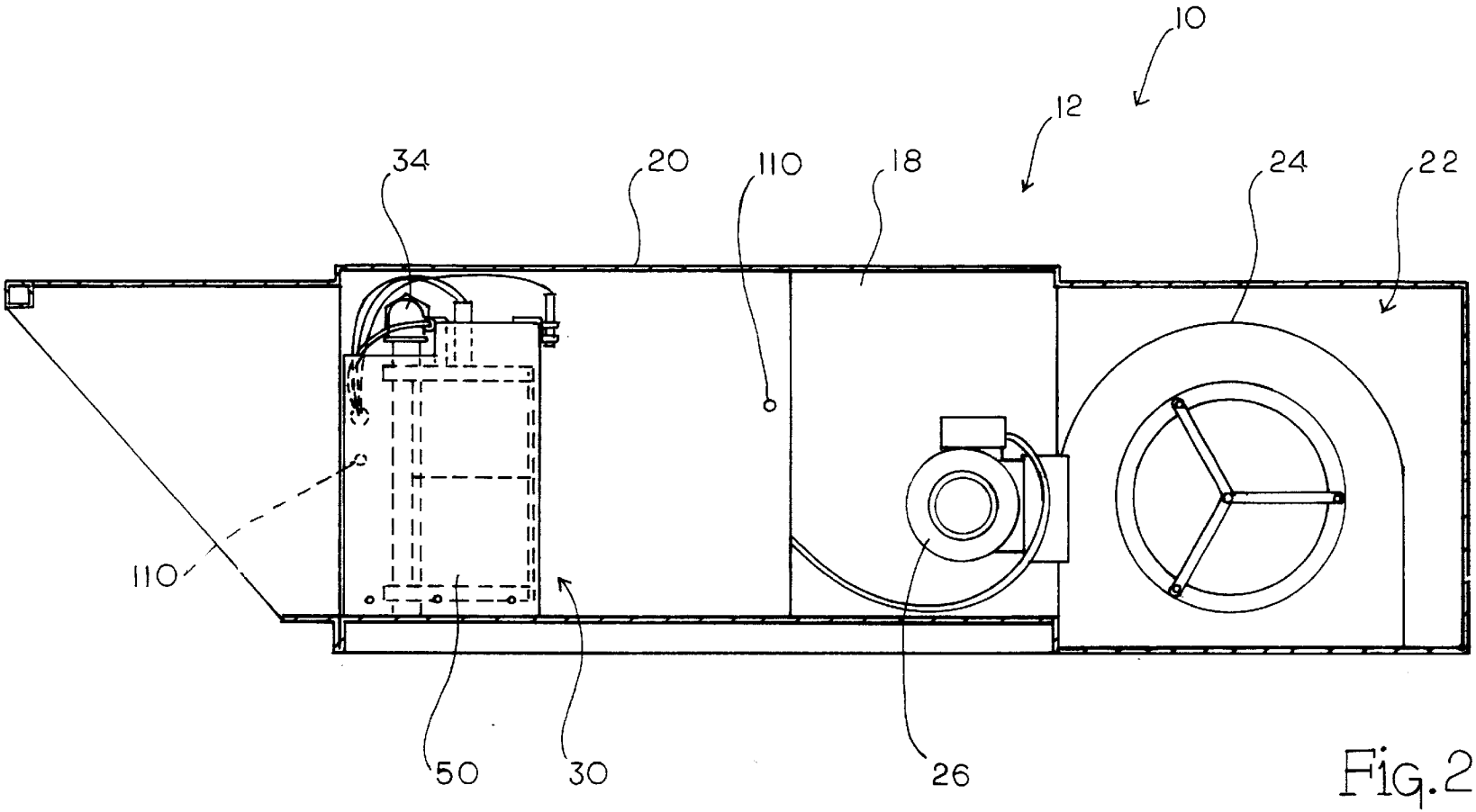
FIG. 2 is a side elevational view of the direct gas-fired heated makeup air unit of the present invention with a sidewall of the duct structure removed to better illustrate the basic components thereof.

Now, turning to a more detailed discussion of the heated air makeup unit 10 of the present invention, it is seen that the same includes a duct structure indicated generally by the numeral 12. The duct structure 12 is made up of a bottom panel 14, a pair of side panels 16 and 18, a top panel 20 and a side panel compartment 21 for housing controls incorporated into the heated air makeup unit 10. See FIGS. 1, 2, and 3.

As shown in FIG. 1, the duct structure 12 of the design shown therein is elongated and includes an air inlet end and a bottom air exiting end. As will be appreciated from subsequent portions of this disclosure, it is seen that air being forced through the heated air makeup unit 10 basically enters one end and is turned 90° through a fan which expels the air downwardly into the kitchen area 13. In the case of the disclosure shown herein, the fan is indicated generally by the numeral 22 and is of the squirrel cage type. It is appreciated, however, that other types of fans can be used. Squirrel cage fan 22 includes an outer housing structure 24 and is powered by an electric motor 26.

Figure 3:
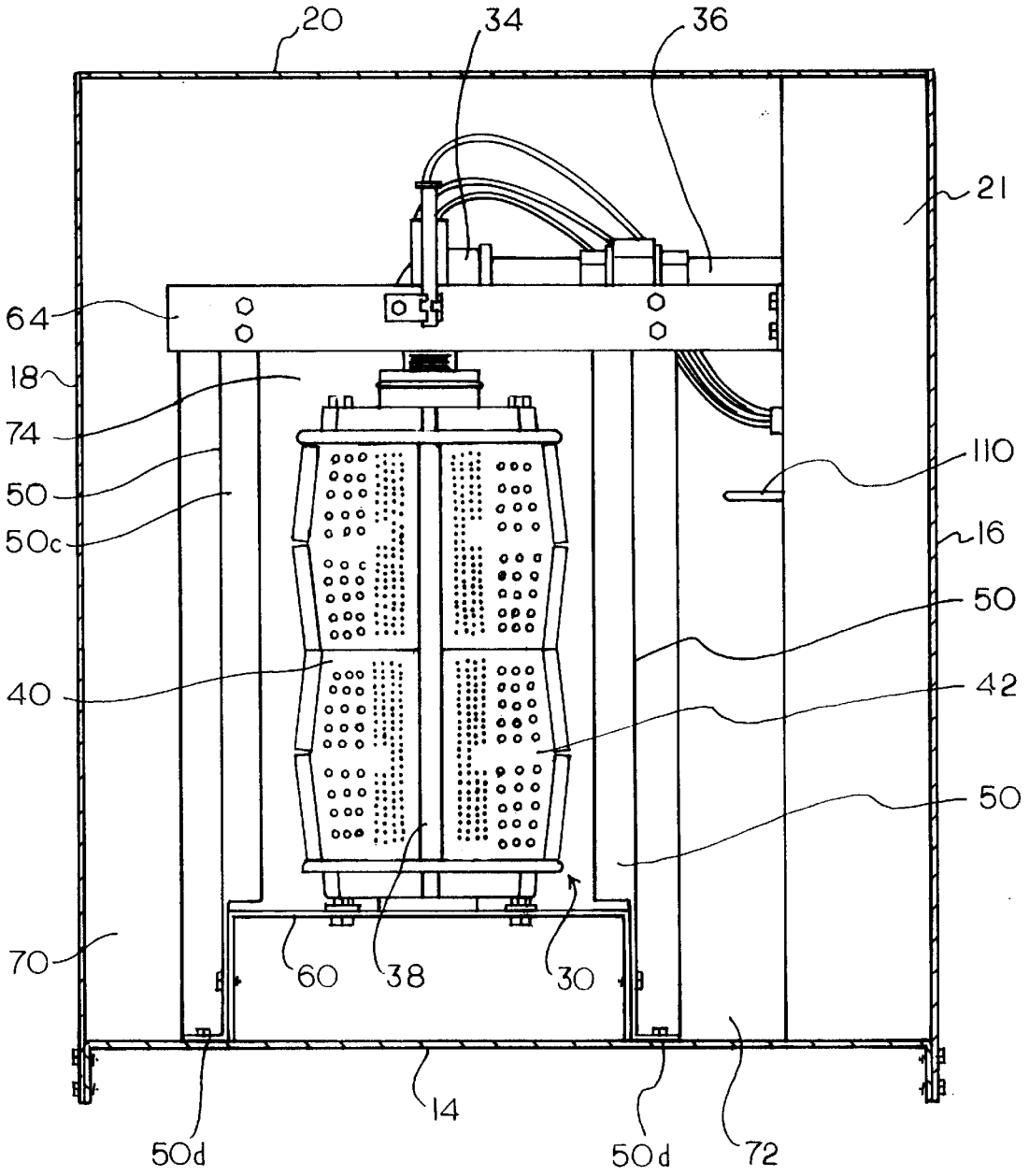
FIG. 3 is an end elevational view of the gas burner and associated fixed airflow directing plates viewed from downstream of the gas burner.
Figure 4:
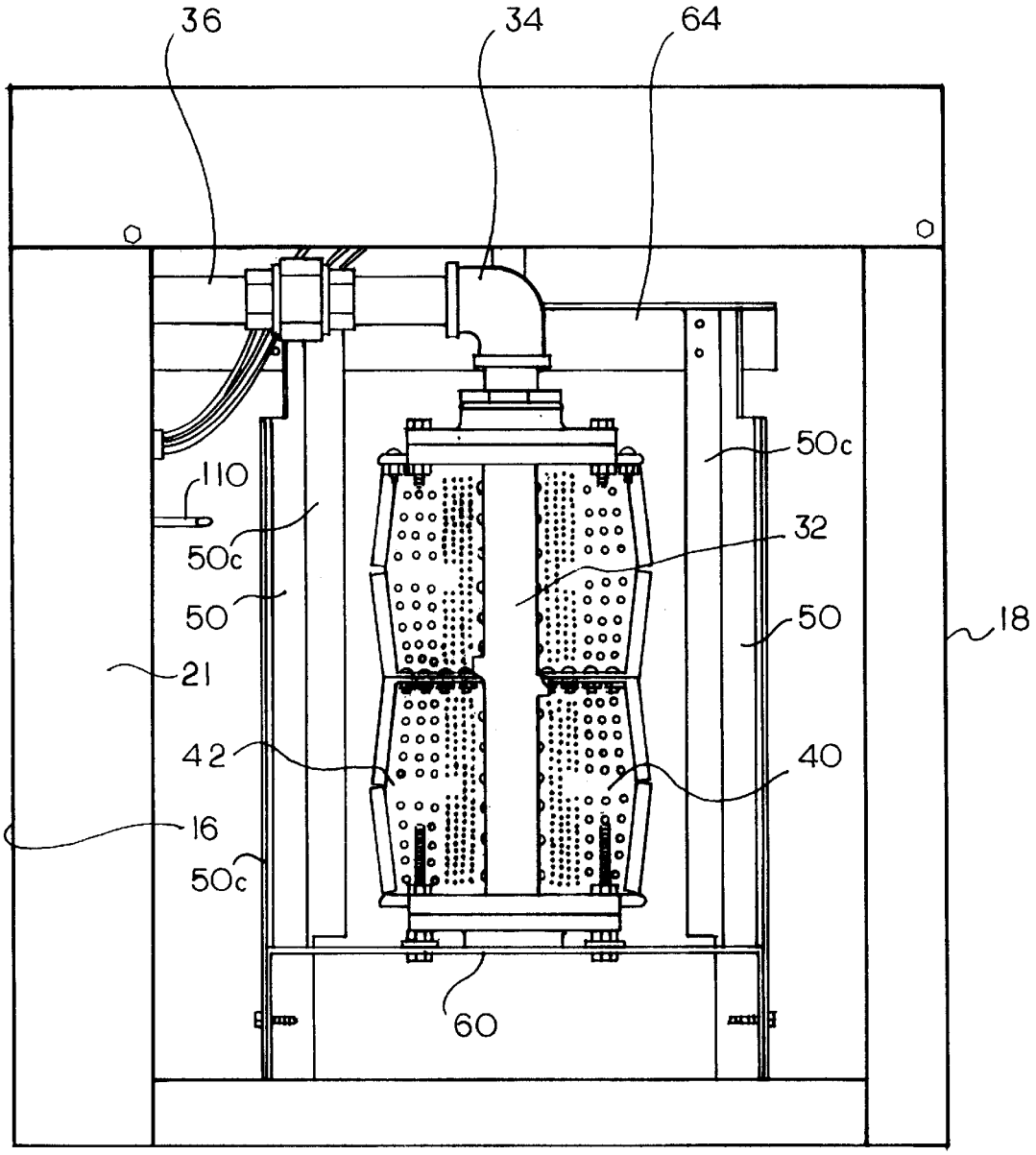
FIG. 4 is an end elevational view similar to FIG. 3 except viewed from upstream of the gas burner.
Figure 5:
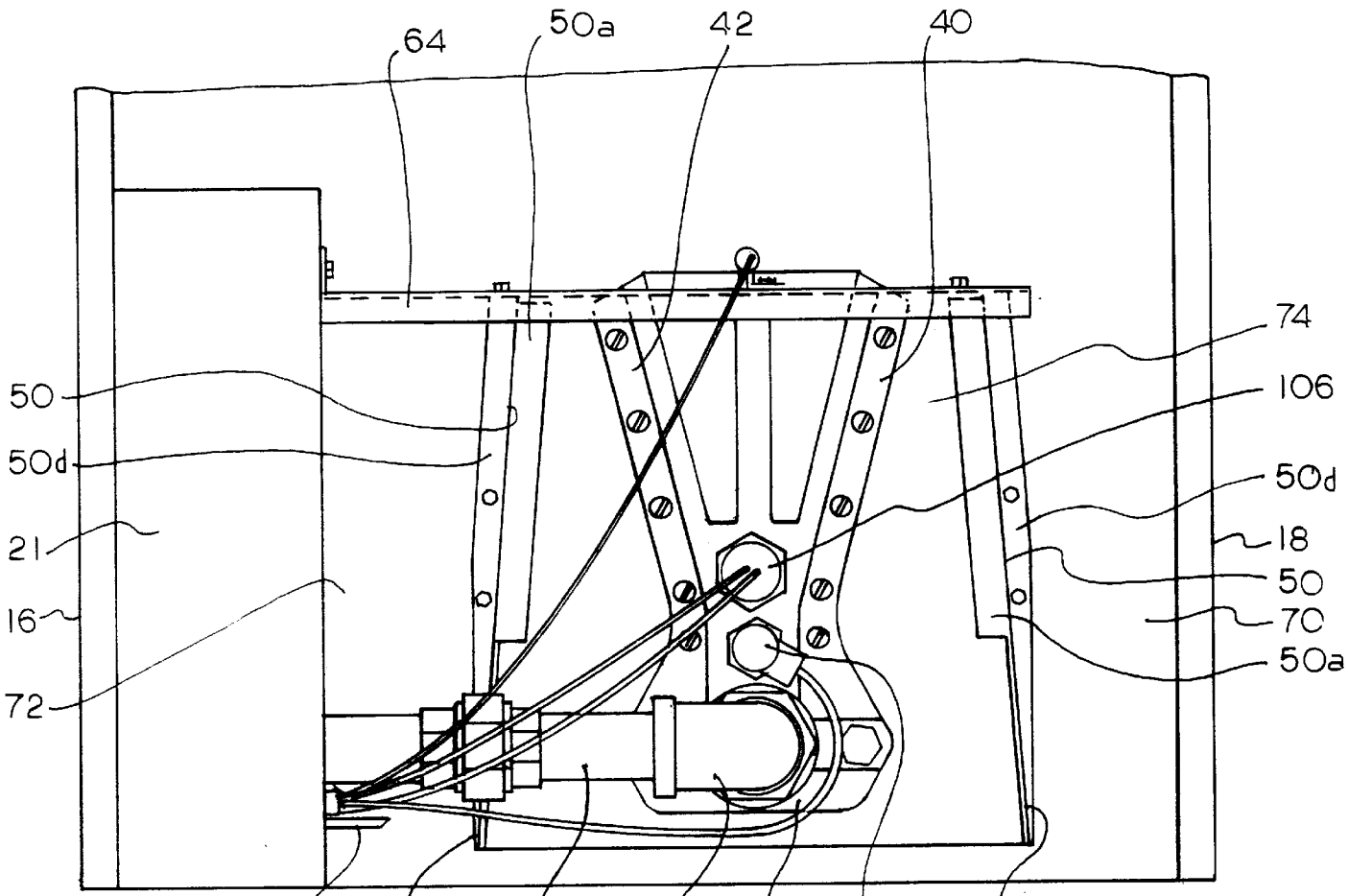
FIG. 5 is a top elevational view of the gas burner and fixed airflow directing plates.

Disposed upstream from the fan 22 is a gas burner indicated generally by the numeral 30. While various types of gas burners may be used, one appropriate gas burner that is commercially available is known as a Maxon Gas Burner. With particular reference to FIGS. 3–5, it is seen that the gas burner 30 includes a head portion 32 that is oriented upstream in the heated air makeup unit 10. Formed adjacent the head portion 32 of the burner 30 is a gas inlet 34 that is coupled to a gas pipe 36 that extends transversely from the burner 30 through one side of the duct structure 22. It is appreciated that gas is supplied to the burner 30 via the gas pipe 36.

Burner 30 also includes a central manifold 38 that disburses gas. Extending outwardly past the manifold 38 and projecting downstream is a pair of diverging mixing plates 40 and 42. It is appreciated that the mixing plates 40 and 42 include perforations formed therein for permitting air to pass therethrough.

The present invention deals with controlling the airflow past the gas burner 30 so as to provide a clean, efficient and odor-free combustion. In particular, it is important to minimize the combustion by-products of carbon monoxide, alithatic aldehydes, nitrogen dioxide, and carbon dioxide. In order to provide for a clean and efficient combustion process, the present invention provides a pair of plates 50 that are disposed on opposite sides of the burner 30 and which are designed to channel and direct air past the burner in such a manner that the airflow rate and the air velocity give rise to optimum combustion properties. Moreover, the plates 50 which are disposed on opposite sides of the burner 30 are designed to yield an optimum air velocity range across the gas burner for a relatively wide range of airflow rates.

With reference to FIGS. 3–5, it is seen that the plates converge about the burner 30. More particularly, each plate 50 includes a trailing edge 50*b* and a leading edge 50*c*. As indicated in the drawings, the trailing edges 50*b* of the plates 50 are spaced wider apart than the leading edges 50*c* of the respective plates. Viewing FIG. 5, note that the trailing edges 50*b* begin slightly upstream of the head section 32 of the burner 30. Also note that the leading edges 50*c* terminate in the general area of the downstream edges of the mixing plates 40 and 42.

Burner 30 is supported upon a U-shaped platform 60 that is supported about the bottom 14 of the duct 12. U-shaped platform 60 rests inside the profile plates 50 and as particularly illustrated in FIG. 3, the lower portion of the fixed plates 50 are secured to the legs of the U-shaped platform 60 by bolts or screws or the like. Moreover, the lower portion of the plates 50 extend on downwardly where their lower edges are turned outwardly to form a lower flange 50*d* that is secured to the bottom 14 of the duct 12. Structural rigidity is provided to the plates by an upper edge being turned inwardly to form an upper flange 50*a*. Additional support is provided the plates 50 by transverse cross member 64 that attaches to an upper leading edge portion of the plates, with the cross member 64 being fastened to an inside wall of the control panel section 21 of the duct structure 12. See FIGS. 3, 4 and 5.

The plates 50, which are fixed in the embodiment illustrated and which are referred to as profile plates, effectively divide the duct 12 into three air passage areas. First, there is defined two outer air passageways 70 and 72. As seen in FIGS. 3–5 and particularly in FIG. 6, the outer two air passages 70 and 72 are defined between the outside of a respective plate 50 and an adjacent sidewall of the duct structure 12. The third air passageway, referred to as an intermediate air passageway is indicated by the reference numeral 74 and is defined between the respective plates 50.

It should also be noted that the leading edges 50*c* of the plates 50 are bent and turned inwardly. While this does provide strength for the plates 50, the inwardly turned edges 50*c* tend to turn the air passing between the plates 50 inwardly into and through the mixing plates 40 and 42 of the burner 30.

Figure 6:
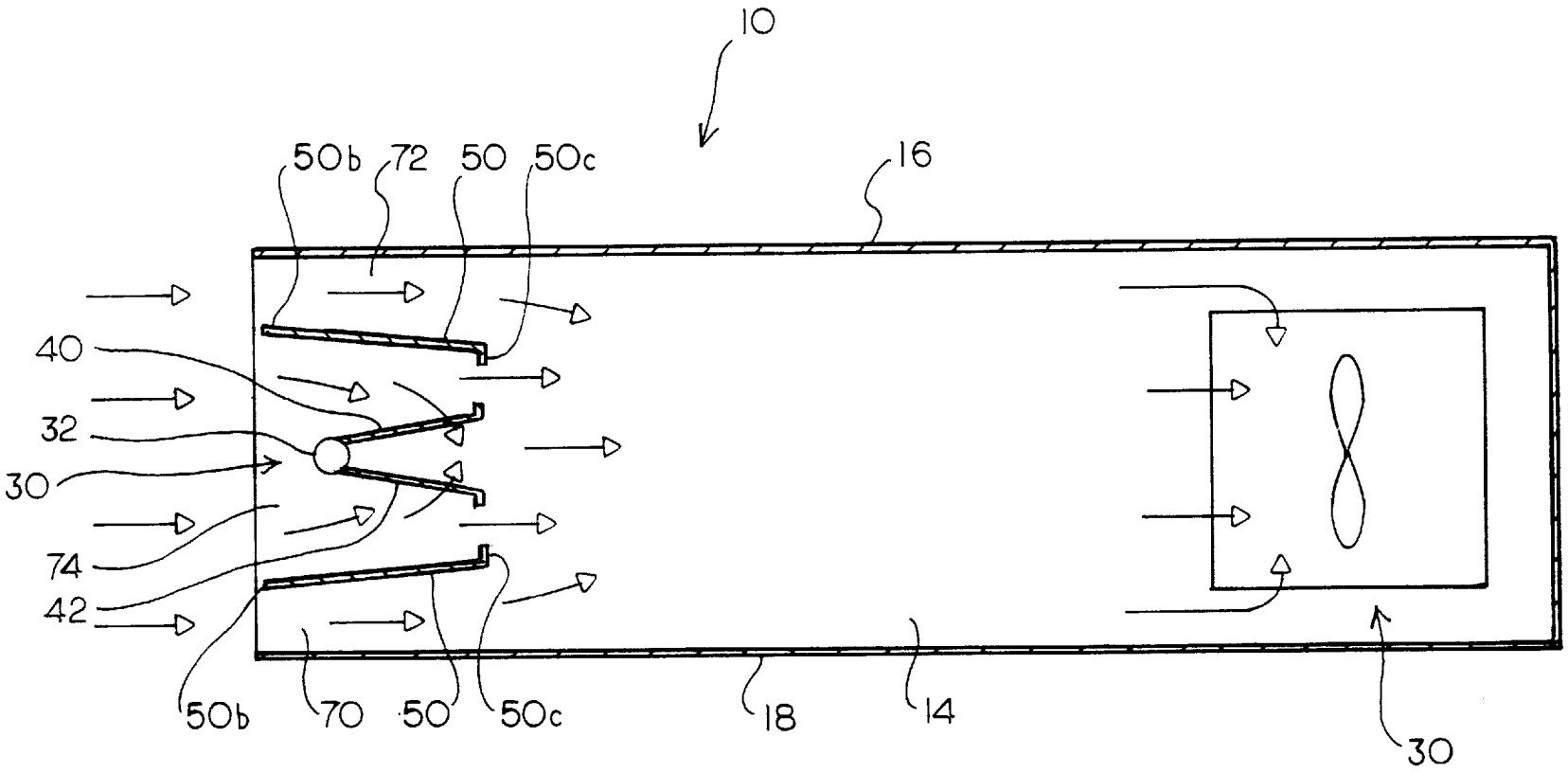
FIG. 6 is a schematic illustration of the gas burner and associated fixed air directing plates which particularly illustrate the flow of air past the gas burner and fixed air deflecting plates.

Thus, it is appreciated that the system of air that enters the duct structure 12 upstream of the burner 30 is divided into three distinct systems of air. First, there are the two outer systems of air that flow through the outer air passages 70 and 72. The third system of air enters between the trailing edges 50*b* of the plates and passes outwardly along and adjacent the mixing plates 40 and 42. Because of the converging nature of the plates 50, the intermediate system of air is caused to be turned generally inwardly resulting in the air passing from the outside through the perforations in the mixing plates 40 and 42. In addition, as illustrated in FIG. 6, some of the air passing between the plates 50 is not necessarily induced or urged through the burner mixing plates 40 and 42 but instead passes between the respective mixing plates 40 and 42 and the leading edge 50*c* of the plates 50. Typically, the air passing through the outer passageways 40 and 42 will converge with heated air passing from the intermediate passageway 74 and the respective air system components will mix and combine downstream from the burner 30.

As seen in the drawings, the air regulating plates converge. In a preferred embodiment, the plates will converge approximately 4 to 8 inches. That is, the distance between the plates at the end portions 50*c* is approximately 4 to 8 inches less than the distance between the opposite end portions 50*b*.

Plates 50 tend to establish an optimum velocity profile across the burner 30 for a range of power settings and flow rates. Basically, the fixed profile plates 50 will produce a velocity profile across the burner 30 that minimizes combustion products and presents an optimum blue flame. The disposition of the plates 50 about the burner 30 has been found to be effective for fans powered by one-half to fifteen horsepower motors and having flow rates of 1200 CFM to 15,000 CFM.

Figure 7:
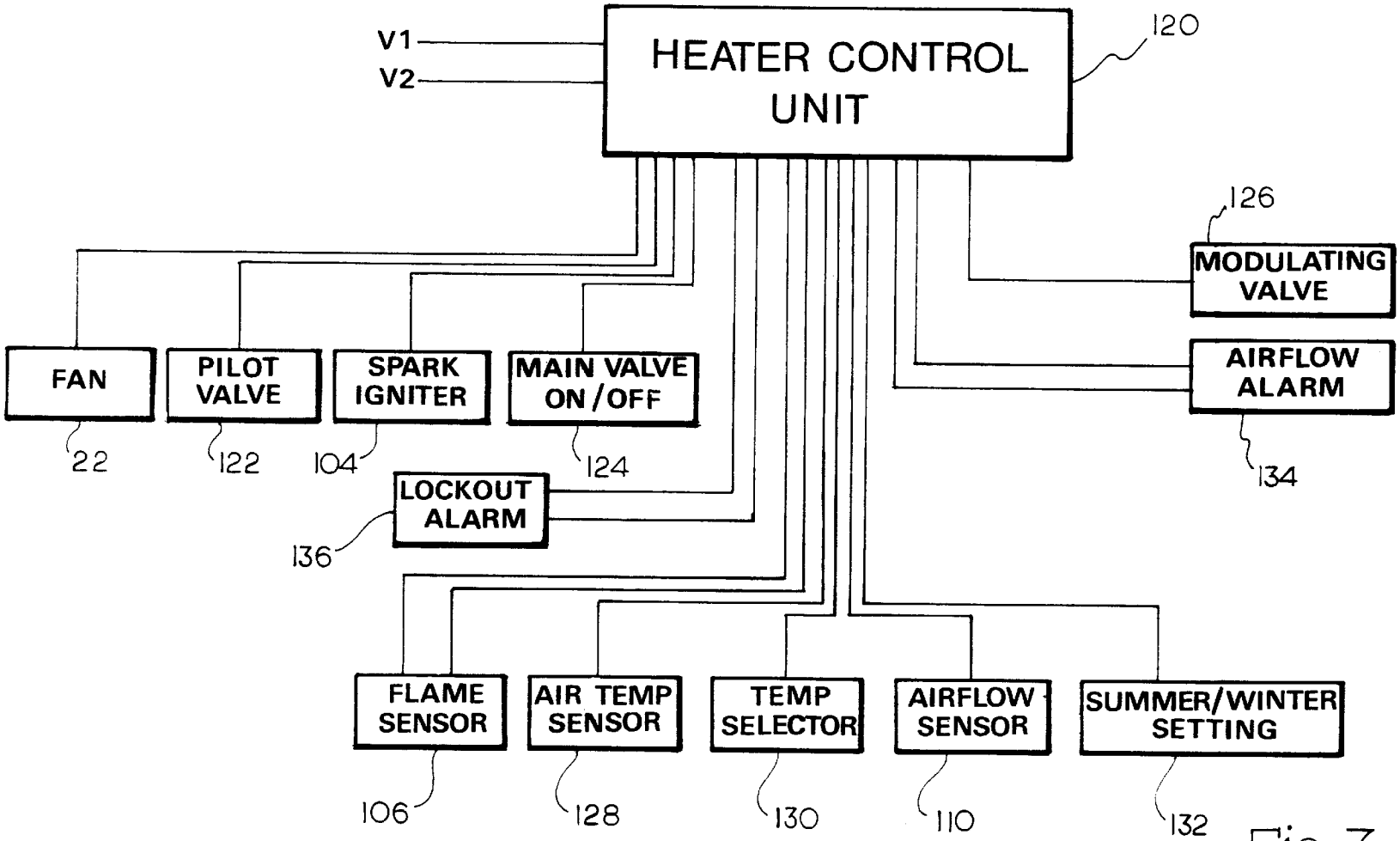
FIG. 7 is a schematic illustration showing the control system for controlling the direct gas-fired heated air makeup unit of the present invention.

A control system for controlling the burner 30, fan 22 and related components is schematically illustrated in FIG. 7. At the center of the control system is a heater control unit 120. Heater control unit 120 is a microprocessor based control device that on a continuing basis monitors air temperature, airflow, flame and also controls the temperature of the air passing through the heated air makeup unit 10. Basically, the heater control unit 120 is preprogrammed to carry out the above monitoring functions as well as a basic temperature control function. Such microprocessor based heater control units 120 are known in the art and are commercially available. For example, Honeywell manufactures a microprocessor based control unit known as 7895A flame safety control system.

Referring to FIG. 7 in more detail, it is seen that the heater control unit 120 of the present invention is designed to accommodate two conventional voltage inputs, V1 and V2. Connected to the heater control unit 120 is the fan 22 (i.e. more particularly the fan motor 26) along with a pilot valve 122, the spark ignitor 104, and at least one main on/off control valve 124.

Although not specifically shown, it is appreciated that the burner 30 is operatively connected to a gas supply line that extends from a gas source. Any number of control valves and control elements can be incorporated into the gas supply line. Typically, a regulator valve (not shown) is provided in this gas line along with a pair of safety main on/off valves 124 and a main control modulating valve 126. The pilot valve 122 is communicatively connected to the main gas supply line and is operative to control the flow of gas to a pilot.

In addition, the heater control unit 120 is operatively connected to a flame sensor 106, an air temperature sensor 128, a temperature selector 130, a pair of airflow sensors 110 and a summer/winter setting control 132. As seen in FIGS. 2–5, the airflow sensors 110 include two airflow probes that extend into the duct structure of the heated air makeup unit. It should be appreciated that a standard way of measuring airflow is by providing a pair of spaced apart probes 110 and measuring differential pressure across the probes in order to determine airflow past the probes. This is a conventional approach to measuring airflow and such airflow probes and associated instrumentation are presently commercially available. Finally, an airflow alarm 134 and a lockout alarm 136 is connected to the same heater control unit 130.

In operation, heater control unit 120 functions to monitor temperature, airflow, and the presence of a flame at the burner and at the same time controls the modulating valve 126 so as to control the temperature of the air passing through the heated air makeup unit 10.

At the outset, once the heater control unit 120 is actuated, the heater control unit is preprogrammed to purge the heated air makeup unit 10. That is, for a selected period of time, say for example 10 seconds, the fan 22 is actuated and that results in a system of air being moved past the burner 30 so as to purge the area in and around the burner of any gas. Once this purge time period has expired, the heater control unit 120 is preprogrammed to open the pilot valve 122. Upon the opening of the pilot valve 122, the spark ignitor 104 is caused to be actuated, resulting in a flame being produced about a pilot burner. At this time, the heater control unit 120 communicates with the flame sensor 106 to determine if a flame is sensed about the pilot burner. If a flame is sensed about the pilot burner, then the heater control unit 120 is preprogrammed to open the main on/off control valves 124. Once the main on/off control valve or valves 124 has been opened, then a main supply of gas can pass therethrough and through the modulating valve 126 to the burner 30. Consequently, the burner 30 is now fully ignited.

Once the burner 30 has been fully ignited, heater control unit 120 functions to control the main modulating control valve 126 and to produce an air temperature that corresponds to the temperature selected on the temperature selector 130. In fact, the heater control unit 130 is preprogrammed to control air temperature via the air temperature sensor 128, temperature selector 130, and modulating control valve 126. In particular, the heater control unit 120 is preprogrammed to interpret the temperature sensed by the air sensor 128 and in response thereto to actuate the modulating control valve 126 so as to produce a temperature corresponding to the temperature set by the temperature selector 130. Air temperature sensor 128 can be placed at various locations in and around the heated air makeup unit 10. However, one particular desirable location for the air temperature sensor 128 is on the downstream side of the fan 22.

During the continuous operation of the control system just described, the heater control unit 120 continues to sense air temperature at a selected point in the heated air makeup unit 10, the airflow passing through the heated air makeup unit, and the presence of a flame in and around the burner 30. Heater control unit 120 is preprogrammed to shut the system down in the event that the air temperature sensor 128 senses a temperature at a particular location that is above a predetermined threshold limit. In addition, the heater control unit 120 senses the airflow, via airflow sensor 102, passing through the heated air makeup unit 10.

In the event that the airflow falls below a predetermined threshold rate, the heater control unit 120 automatically responds by shutting down the system. Finally, through the flame sensor 106, the heater control unit continually senses and monitors for the presence of a flame at the burner 30. In the event there is no flame sensed, then the heater control unit 120 automatically shuts down the entire control system. In particular, in all cases, the system is shut down by the heater control unit 120 closing the main on/off control valve or valves 124.

Therefore, it is appreciated that the control system of the present invention and particularly the heater control unit 120 serves a series of safety functions as well as an ongoing control function. As shown in FIG. 7, the heater control unit 120 is coupled both to an airflow alarm 134 and a lockout alarm 136 that can be located in a remote location from the heated air makeup unit 10.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. In a commercial kitchen of the type having an exhaust system for exhausting air from the kitchen and a makeup air system for heating outside air and directing the heated outside air into the kitchen to replace exhausted air, a direct gas-fired kitchen makeup air unit comprising:

(a) a duct structure;

(b) a gas burner mounted in the duct structure;

(c) a fan for moving air through the duct structure and past the burner; and (d) a pair of spaced-apart air-directing plates disposed outwardly of the burner, the plates converging in the direction of airflow through the duct structure and defining two outer airflow channels, one between each air-directing plate and the duct structure, and a central airflow channel between the air-directing plates themselves and aligned with the burner.

2. The kitchen makeup air unit of claim 1, wherein the air-directing plates are fixed.

3. The kitchen makeup air unit of claim 1, wherein each air-directing plate extends a substantial distance along a side of the burner.

4. The kitchen makeup air unit of claim 3, wherein the gas burner includes an air entry end and wherein the air-directing plates extend past the air entry end of the burner such that air passing through the duct structure encounters the air-directing plates prior to reaching an air entry end of the burner.

5. The kitchen makeup air unit of claim 4, wherein each air-directing plate includes a trailing edge portion and wherein there is provided an inwardly turned flange that is formed on the trailing edge portion of each air-directing plate.

6. The kitchen makeup air unit of claim 1, wherein the burner includes an upstream head and a pair of diverging mixing plates that extend downstream therefrom, and wherein the air-directing plates extend upstream past the head and also extend a substantial distance alongside the mixing plates such that the burner is substantially bounded on opposite sides by the air-directing plates.

7. The kitchen makeup air unit of claim 6, wherein the air-directing plates include trailing edge portions and wherein the trailing edge portion of each air-directing plate terminates outwardly of the mixing plates of the burner so as to define an opening between the trailing edge portions of the air-directing plates and the mixing plates of the burner.

8. The kitchen makeup air unit of claim 1, wherein the burner is mounted on a raised platform in the duct structure, wherein the air-directing plates extend upwardly adjacent the raised platform, and wherein there is provided at least one cross-member connected to both air-directing plates and extending transversely across the duct structure.

9. The kitchen makeup air unit of claim 8, wherein the cross-member is connected to a sidewall of the duct structure.

10. The kitchen makeup air unit of claim 8, wherein the air-directing plates and platform form an assembly, wherein the assembly includes a lower turned flange secured to a bottom panel of the duct structure, and wherein the air-directing plates include an upper turned flange.

11. A commercial kitchen makeup air system for heating outside air and directing the same into a commercial kitchen to replace exhausted air, comprising:

(a) a duct structure having opposed sidewalls;

(b) a fan for moving air through the duct structure;

(c) a gas burner mounted in the duct structure upstream from the fan and including a head portion and a pair of diverging mixing plates projecting downstream from the head portion;

(d) a pair of laterally spaced, converging air-directing plates mounted on opposite sides of the burner and extending alongside and adjacent the mixing plates and further extending upstream past the head portion of the burner;

(e) wherein the air-directing plates are spaced inwardly from the opposed sidewalls of the duct structure so as to define three air passages through the duct structure in the vicinity of the burner, the three air passages including:

(i) two outer air passages defined between respective air-directing plates and adjacent sidewalls of the duct structure, and (ii) a central air passage defined between the air-directing plates and aligned with the burner; and (f) wherein the air-directing plates are spaced so as to converge in a downstream direction so as to direct air entering the central air passage into and through the mixing plates of the burner, while air passing through the outer passageways bypasses the burner before combining with heated air that has passed through the central passageway.

12. The kitchen makeup air unit of claim 11, wherein each air-directing plate and adjacent mixing plate become progressively closer to each other in the downstream direction.

13. The kitchen makeup air unit of claim 11, wherein the laterally spaced air-directing plates include leading and trailing edge portions and wherein the distance between the trailing edge portions is approximately 4 to 8 inches less than the distance between the leading edge portions.

14. The kitchen makeup air unit of claim 11, wherein each air-directing plate forms a wall adjacent one of the mixing plates of the burner, and wherein the wall formed by each air-directing plate directs air inwardly towards the adjacent mixing plate, resulting in the air being directed into the burner for purposes of combustion.

15. The kitchen makeup air unit of claim 11, wherein the air-directing plates extend the full height of the burner.

16. A direct gas-fired heating apparatus comprising:

(a) a duct structure having surrounding walls;

(b) a fan for moving air through the duct structure;

(c) a gas burner mounted in the duct structure for heating air being moved past the burner by the fan, the burner including an upstream end portion and a downstream end portion;

(d) a pair of laterally spaced, converging plates disposed outwardly of the burner but inwardly of the surrounding walls of the duct structure for directing air into and through the burner, each plate including leading and trailing end portions, wherein the leading edge portion of each plate is disposed upstream of the upstream end portion of the burner, and wherein the plates extend downstream past the upstream end portion of the burner such that the plates extend adjacent a substantial portion of the burner;

(e) wherein the laterally spaced, converging plates define three air passages through the duct structure, including two outer air passages defined between the respective plates and the surrounding walls of the duct structure and a third intermediate air passage between the plates that are aligned with the burner;

(f) wherein the laterally spaced plates split the air passing through the duct structure into three components; and (g) wherein the air passing through the outer air passages bypasses the burner and mixes with heated air passing through the intermediate air passage downstream of the burner.

17. The apparatus of claim 16, wherein the laterally spaced plates are spaced in converging relationship with the burner so as to give rise to a velocity profile across the burner that maintains an efficient combustion process for a range of airflow rates through the duct structure.

18. A direct gas-fired heating unit and a control system therefore, comprising: a gas burner; a fan for moving air past the gas burner; a pilot valve for controlling the flow of gas to the gas burner; a spark ignitor associated with the gas burner for igniting a flame; a modulating gas valve for variably controlling the flow of gas to the gas burner; a flame sensor associated with the gas burner; an air temperature sensor disposed downstream of the gas burner; an airflow sensor for sensing the flow of air in the vicinity of the gas burner; a temperature selector for establishing a set controlled temperature; a preprogrammed heater control unit operatively connected to the fan, pilot valve, spark ignitor, modulating gas valve, flame sensor, air temperature sensor, airflow sensor, and temperature selector for controlling the startup of the gas burner and for maintaining a controlled temperature set by the temperature selector and for further sensing temperature, airflow and the presence of a flame at the gas burner and for shutting down the gas burner in response to airflow falling below a predetermined air flow rate, the sensed temperature exceeding a high limit temperature, or the failure of the flame sensor to sense a flame at the site of the gas burner; and wherein the preprogrammed heater control unit functions to read the temperature sensed by the downstream temperature sensor and to modulate the modulating gas valve to vary the gas supply being directed to the gas burner so as to control and maintain the temperature in the vicinity of the downstream sensor at the temperature established by the temperature selector.

19. The direct gas-fired heating unit and control system of claim 18 wherein the preprogrammed heater control unit purges the area around the vicinity of the gas burner for a selected period of time prior to the actuation of the spark ignitor.

20. The direct gas-fired heating unit and control system therefore of claim 19 wherein the preprogrammed heater control unit actuates the fan prior to the actuation of the spark ignitor for a selected time period such that air is moved past the gas burner prior to the gas burner being actuated so as to purge the area of gas in the vicinity of the gas burner.

21. The direct gas-fired heating unit and control system therefore of claim 18 wherein there is provided an airflow alarm that is actuated by the preprogrammed heating control unit in response to the airflow falling below a predetermined flow rate.

22. The direct gas-fired heating unit and control system of claim 18 including at least one main on/off control valve operatively connected to the preprogrammed heater control unit and wherein the heater control unit in the course of starting up the direct gas-fired heating unit opens the main on/off control valve in response to the pilot valve being opened and the presence of a flame being sensed at the gas burner.

23. The direct gas-fired heating unit and control system of claim 18 wherein the air temperature sensor, temperature selector, and modulating gas valve are all interconnected via the heater control unit for control purposes and for controlling the flow of gas through the modulating valve so as to maintain a temperature corresponding to an established temperature set by the temperature selector.

24. A direct gas-fired heating system comprising: a gas burner; a fan driven by a motor for generating a system of moving air that moves past the gas burner; a preprogrammed heating control unit for both controlling and monitoring the direct gas-fired heating system; the heating control unit being programmed to monitor airflow, the presence of a flame at the gas burner, and the temperature of the air being heated by the gas burner and to shut down the heating system when in an operating mode in the event that the temperature of the air exceeds a predetermined high limit, the flow of air being generated by the fan falling below a predetermined level, or the failure to sense a flame at the site of the gas burner; and wherein the heater control unit is further operative to control the flow of gas to the gas burner and to maintain the temperature of the air heated by the gas burner at a selected temperature.

25. The direct gas-fired heating system of claim 24 wherein the heating control unit includes means for actuating the fan prior to the startup of the gas burner so as to purge the area around the gas burner of gas prior to ignition.

26. The direct gas-fired heating system of claim 24 including an air temperature sensor, a temperature selector, and a modulating control valve for controlling the flow of gas to the gas burner and wherein the temperature sensor, temperature selector, and modulating valve are all interconnected via the heater control unit and wherein the heater control unit is effective to control the temperature of the air heated by the gas burner so as to maintain a temperature corresponding to a set point temperature established by the temperature selector and wherein this control is effectuated by controlling the modulating gas valve.

* * * * *